US006042486A

United States Patent [19]

Gallagher

[11] Patent Number: 6,042,486

[45] Date of Patent: Mar. 28, 2000

[54] GOLF CLUB HEAD WITH DAMPING SLOT AND OPENING TO A CENTRAL CAVITY BEHIND A FLOATING CLUB FACE

[76] Inventor: Kenny A. Gallagher, 11711 Coley River Cir., #11, Fountain Valley, Calif. 92708

[21] Appl. No.: 08/991,626

[22] Filed: Nov. 4, 1997

[51] Int. Cl.[7] ..... A63B 53/04

[52] U.S. Cl. ..... 473/329; 473/332; 473/350; 473/342

[58] Field of Search ..... 473/324, 330, 473/331, 329, 332, 335, 345, 349, 350, 342; D21/747, 748, 749, 750, 751

[56] References Cited

U.S. PATENT DOCUMENTS

| | | | |
|---|---|---|---|
| D. 234,206 | 1/1975 | Cook . | |
| D. 364,206 | 11/1995 | Schmidt et al. . | |
| 1,154,490 | 9/1915 | Davis | 473/329 |
| 2,034,936 | 3/1936 | Barnhart . | |
| 2,429,351 | 10/1947 | Fetterolf | 473/329 |
| 4,027,885 | 6/1977 | Rogers | 473/342 |
| 4,252,262 | 2/1981 | Igarashi | 473/342 |
| 4,398,965 | 8/1983 | Campau | 473/329 |
| 5,282,625 | 2/1994 | Schmidt | 473/350 |
| 5,318,296 | 6/1994 | Adams et al. . | |
| 5,492,327 | 2/1996 | Biafore | 473/332 |
| 5,499,814 | 3/1996 | Lu . | |
| 5,529,543 | 6/1996 | Beaumont | 473/332 |
| 5,540,436 | 7/1996 | Boone . | |
| 5,575,723 | 11/1996 | Take et al. . | |
| 5,595,552 | 1/1997 | Wright et al. . | |
| 5,643,111 | 7/1997 | Igarashi . | |
| 5,766,093 | 6/1998 | Rohrer . | |

*Primary Examiner*—Sebastiano Passaniti
*Attorney, Agent, or Firm*—Myers, Dawes & Andras LLP

[57] ABSTRACT

An innovative golf club head is disclosed that beneficially dampens the transmission of shock and vibration from the front hitting face to the hosel and associated shaft, and is more tolerant of inadvertent mis-hits of the golf ball. The golf club head includes a front hitting face is isolated to some degree from the hosel by a heel-side face aperture located in the front hitting face near the heel between the front hitting face and the hosel. The heel-side face aperture preferably extends through the golf head from the front hitting face to the back face. The invention may reside in blade-type club or in a cavity-back club having a cavity in its back face that defines a perimeter weighted golf club head. In the latter case, the heel-side face aperture may be provided as a slot which connects the front hitting face to the central cavity in the back face. The innovative golf club head may also have a toe slot which connects a toe of the golf club head to the central cavity and "floats" the front hitting face relative to the heel and toe of the club. If desired, the front hitting face may be floated relative to the top rail and sole, as well, such that it forms an "island." In all of the above embodiments, a vibration-dampening material is preferably placed within a fill void consisting of the heel-side face aperture, the central cavity, and the toe slot (as present).

35 Claims, 5 Drawing Sheets

10
20
21
30
31
32
33
34
40
41
42
50
60
70

GOLF CLUB HEAD WITH DAMPING SLOT AND OPENING TO A CENTRAL CAVITY BEHIND A FLOATING CLUB FACE

BACKGROUND OF THE INVENTION

1. Field of the Invention

The present invention relates generally to golf club heads.

2. Description of Related Art

As is well known, a golf club generally consists of a shaft and a golf club head attached to the bottom of the shaft. Because of the ever gaining popularity of the sport, there exists a very competitive market for golf clubs which include technical innovations that increase distance, accuracy, or both, and which provide a better sound or feel upon striking the golf ball. A number of these innovations have found their way into the golf club head, per se, which generally comprises a hosel adapted for connection to a shaft, and a head body connected to the hosel wherein the head body has a front hitting face and a back face that are collectively encompassed by a top rail, a heel located near the hosel, a sole, and a toe located away from the hosel.

One particularly well known innovation with respect to golf club heads was the development of perimeter weighting, wherein a central cavity is formed in the back face of the golf club head which results in a larger percentage of the head's mass being present in the head's perimeter. The perimeter weighting widens the "sweet spot" on the golf club head's front hitting face so that the golf club is more tolerant to off-angle strokes. A less experienced golfer, in other words, is more likely to have a shot which deviates less than usual from the arc of the stroke when the golfer has the head "open" or "closed" relative to the ideal.

Notwithstanding the significant innovation of perimeter weighting, there still exists a significant need to provide a golf club head which is more tolerant to a golfer's inadvertent misplacement of the front hitting surface upon contact with the ball.

Another problem with the prior art golf clubs and associated golf club heads is the transmission of the shock of impact from the golf club head to the shaft and ultimately to the golfer. This phenomena of shock and transmission is most prevalent in the so-called "irons" because there is generally direct metal to metal transmissions from the front hitting face to the hosel which attaches to the shaft. The result of shock transmission to the golfer can range from an undesirable "feel" to minor pain and even to short or long term injury.

A number of golf club manufacturers have developed golf clubs that attempt to reduce the transmission of vibration up the shaft of the golf club. A manufacturer of golf club shafts called Tru-Temper, for example, has placed a polymer or sponge-like material in the shaft. This particular product, known as the SENSICORE™, is helpful, but suffers from the fact that it merely attempts to dampen vibration that has already been transmitted to the shaft.

Others have attempted to dampen the vibrations within the golf club head itself. For example, in U.S. Pat. No. 5,595,552 entitled "GOLF CLUB HEAD WITH TUNING AND VIBRATION CONTROL MEANS," issued Jan. 21, 1997, the inventors disclose a golf club head wherein a plurality of spoke-like ribs are molded in a central cavity on the back face of the golf club head. According to the inventors, these ribs eliminate or tenuate undesirable vibrations.

As another example, in U.S. Pat. No. 5,573,723 entitled "GOLF CLUB WITH CUSHION MATERIAL BETWEEN SHAFT AND HEAD," issue Nov. 19, 1996, the inventors disclose a "driver" or "wood" wherein the golf club head is a hollow cast metal shell. The inventors in the '723 patent generally disclose removing a portion of the hosel within the cast metal shell so as to expose a portion of the shaft therein and then filling the hollow metal shell with a cushioning material that is softer than the head body, such as a synthetic resin. The '723 patent discloses a cushioning material between the head body and the shaft, but is only suitable for use with a golf club head formed from a hollow metal casting, and does not disclose an arrangement which independently isolates the front hitting face from the shaft while retaining a solid connection between the golf club head and the shaft.

There remains a significant need, therefore, for a golf club head that is more accurate and more forgiving and which more efficiently dampens the transmission of shock vibrations from the front hitting face to the golf club shaft.

SUMMARY OF THE INVENTION

In a first aspect, the invention may be regarded as a golf club head having a hosel adapted for connection to a shaft and a head body connected to the hosel wherein the head body is a front hitting face and a back face collectively encompassed by a top rail, a heel located near the hosel, a sole, and a toe located away from the hosel. In this context, the invention comprises a heel-side face aperture located in the front hitting face near the heel to isolate a substantial portion of the front hitting face from the hosel. In a more specifically defined embodiment, the heel-side face aperture extends through the golf club head from the front hitting face to the back face and, in an even further defined embodiment, the heel-side aperture defines a fill void and a dampening material that is softer than the golf club head and is located within the fill void. The dampening material used may include, but is not limited to, a polymer, an elastomer, cork, compressed wood, and rubber. The presently preferred dampening material is urethane of hardness 75 to 95 on a "Shore A" scale.

In a second aspect, the invention may be regarded as a golf club head comprising a central cavity in the back face which thins a central portion of the golf club head behind the front hitting face and defines a relatively massive perimeter portion in conjunction with a heel-side face slot that extends continuously from the top rail to the sole and that is open to a heel end of a central cavity in the back face whereby a substantial portion of the front hitting face is isolated from the hosel.

In a third even more detailed aspect, the invention may be regarded as a golf club head as just described but further having a toe slot extending from the toe to the central cavity. In this aspect, the heel-side face slot and toe slot combined to isolate the front hitting face from the heel and toe such that the front hitting face is substantially supported only from the top rail and the sole.

In those embodiments the invention which involve a central cavity in the back face of the golf club head, it is generally desirable to further include a perimeter undercut that extends beneath all or a portion of a relatively massive perimeter portion. The perimeter undercut, if present, may be a full "360 degree" undercut that extends beneath the entire perimeter portion or may extend only beneath a part of the perimeter portion, such as the heel, the sole and the toe region.

BRIEF DESCRIPTION OF THE DRAWINGS

The just summarized invention can be best understood with reference to the following description taken in view of the drawings of which:

FIG. 3B-1 is similar to FIG. 3A except that it shows the geometry of the central cavity and a 360 degree undercut in broken lines;

FIG. 3B-2 is similar to FIG. 3A except that it shows the geometry of the central cavity and a partial undercut in broken lines;

DETAILED DESCRIPTION OF THE PREFERRED EMBODIMENTS

Figure 6A:
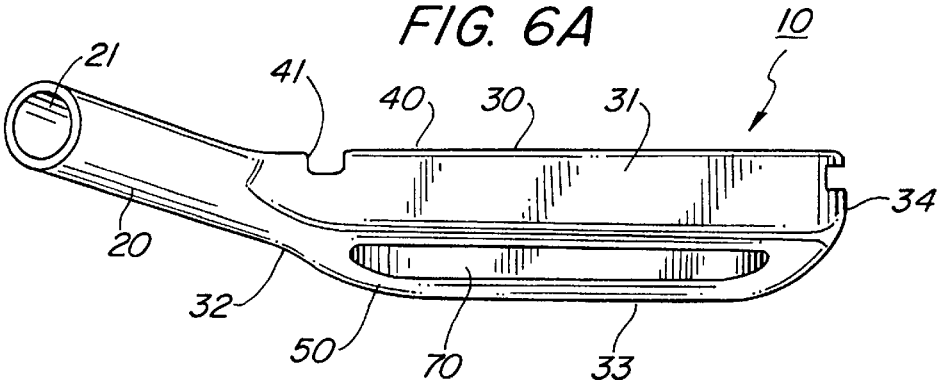
FIG. 6A is a top plan view of the cavity-back golf club head incorporating the present invention showing the heel-side face slot, the cavity, and the toe slot without the vibration-dampening material.
Figure 6B:
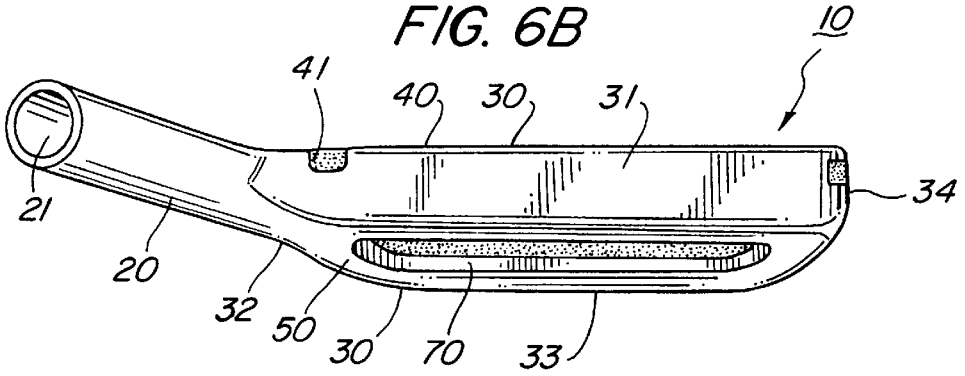
FIG. 6B is similar to FIG. 6A except that the vibration-dampening material is present.
Figure 6C:
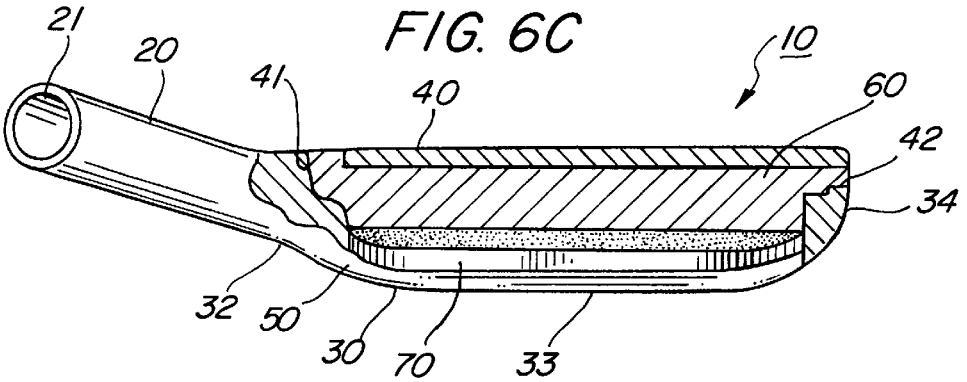
FIG. 6C is a partial cut-away view of the golf club head of FIG. 6B showing how the front hitting face is isolated from the heel and toe of the golf club head.
Figure 6D:
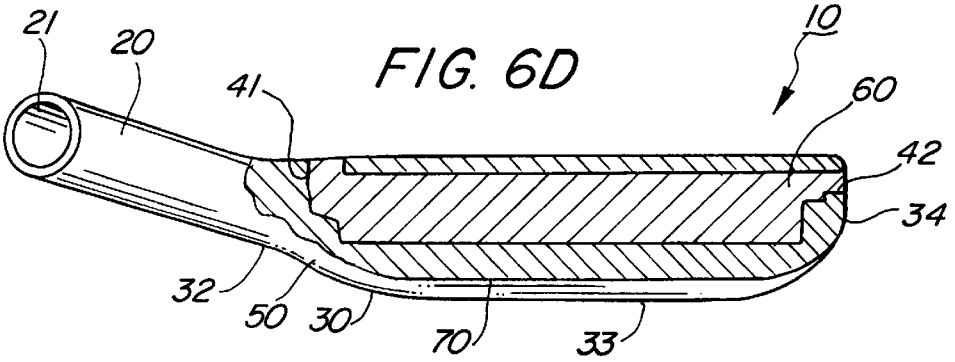
FIG. 6D is a partial cut-away view of a blade-type golf club head incorporating the present invention.
Figure 7:
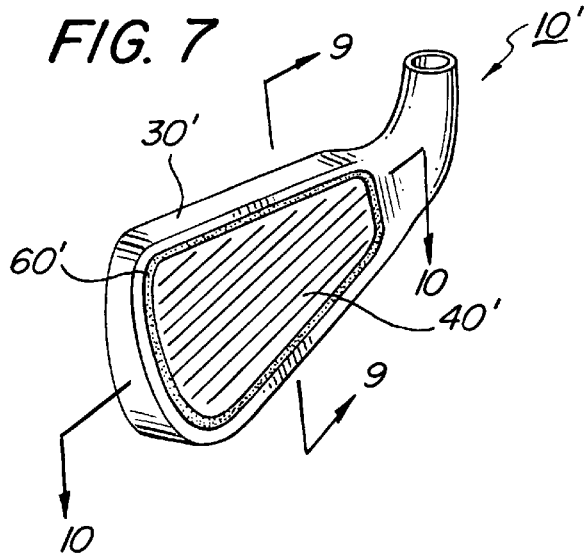
FIG. 7 is a perspective view of an insert-face golf club head incorporating the present invention.
Figure 8:
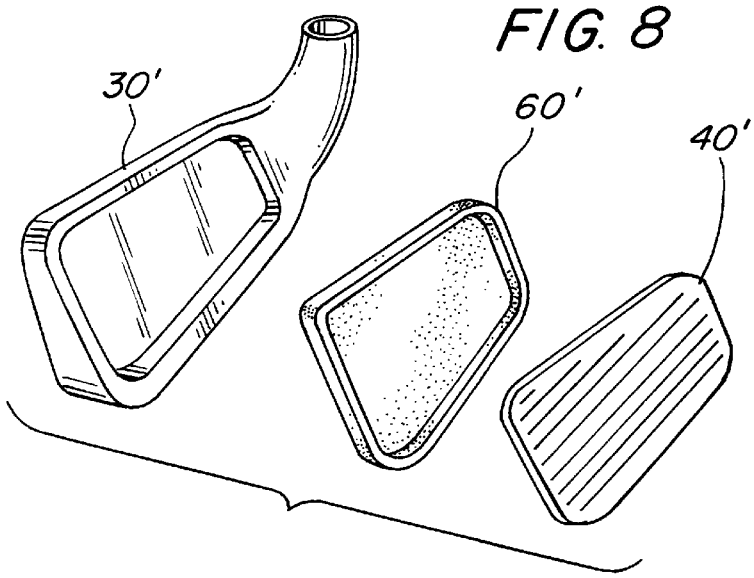
FIG. 8 is an exploded view of the golf club head of FIG. 7.
Figure 9:
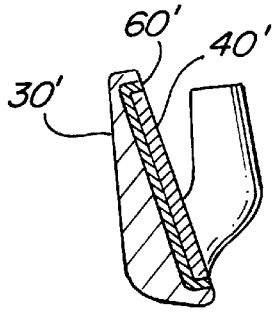
FIG. 9 is a sectional view of the golf club head of FIG. 7 taken along section lines 9—9.
Figure 10:
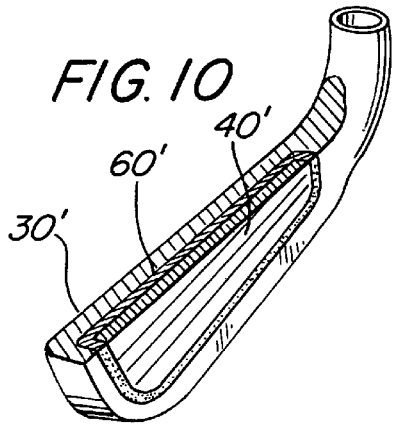
FIG. 10 is a cut-away perspective view of the golf club head of FIG. 7 taken along a horizontal axis thereof.

As shown throughout the figures, the present invention relates generally to a golf club head 10 of most any desired type. It can be a cavity-back head 10 as shown in most of the figures, a blade-type head 10 as shown in FIG. 6D, or an insert-face head 10 as shown in FIGS. 7–10. Such golf club heads may be manufactured in a variety of ways, including casting, forging, and CNC milling.

A golf club head 10 suitable for incorporating the present invention generally has a hosel 20 and a head body 30. The hosel 20 contains an elongated aperture 21 which fixedly receives a shaft (not shown) in any manner well known in the art. The golf club head 30 is generally integral with the hosel 20 in that both of these components are conventionally formed during a single casting operation.

The golf club head 10 specifically comprises a front hitting face 40 and a back face 50 that are collectively surrounded or encompassed by a top rail 31, a heel 32 located near the hosel 20, a sole 33, and a toe 34 located away from the hosel 20.

A first significant feature that distinguishes the golf club head 10 from the known prior art is the provision of a heel-side face aperture 41 in the front hitting face 40. The heel-side face aperture 41 preferably extends through the golf club head 10 from the front hitting face 40 to the back face 50. As shown throughout the figures, the heel-side face aperture 41 is preferably filled with a vibration-dampening material 60 that is softer than the material forming the head body 30 and hosel 20 of the golf club head 10 (typically metal). The heel-side aperture 41 with and without the vibration-dampening material 60 is shown, for example, in FIGS. 1 and 2, respectively.

As can now be appreciated from this description and the drawings, the heel-side face aperture 41 effectively isolates a substantial portion of the front hitting face 40 from the hosel 20. The heel-side aperture 41 also isolates the front hitting face 40 from the heel 32 if it is positioned sufficiently away from hosel 20. As a result of this innovation, when the golf club head 10 is used to strike a golf ball (not shown) there is no direct metal to metal shock transmission path from the front hitting face 40 to the hosel 20. Moreover, because of the vibration-dampening material 60, much of the shock and vibration associated with striking the golf ball may be dampened and thereby rapidly reduced in amplitude. Accordingly, the golf club head 10 in accordance with this aspect of the invention will have a softer feel and will be less likely to annoy or injure the golfer.

Figure 3A:
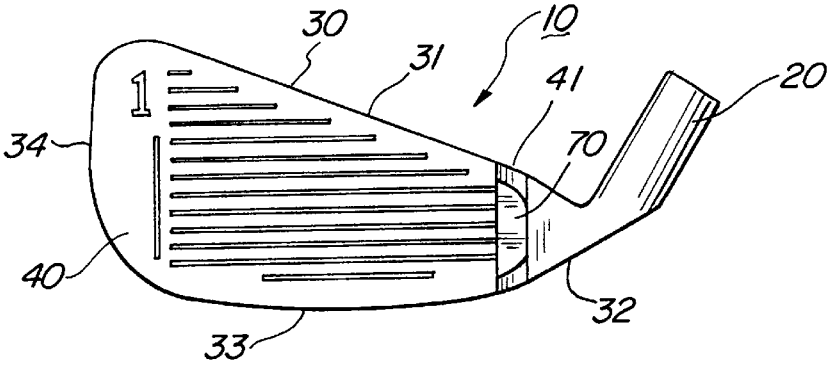
FIG. 3A is an elevational view of the preferred golf club head of the present invention showing the connection between the heel-side face slot and the central cavity.

In a second aspect of the present invention, the heel-side face aperture 41 is implemented in the context of a golf club head 10 which includes a central cavity 70 and its back face 50. The central cavity 70 forms a perimeter weighted golf club head of the type well known in the art. In accordance with the present invention, however, the heel-side face aperture 41 extends from the front hitting face 40 to the central cavity 70 formed on the back face 50 of the head body 30. This connection is best seen in the FIGS. 1, 3A and 3B. In this particular context, the heel-side face aperture 41 is preferably provided as a heel-side face slot 41 that is easily machined into the golf club head 10 after it is removed from the mold cavity (not shown). The result of having the heel-side face slot 41, as shown in FIG. 3A, is to reveal an opening to a heel end of the central cavity 70. In a blade-type head 10 as shown in FIG. 6D, the central cavity would be enclosed by the back face.

Figure 5:
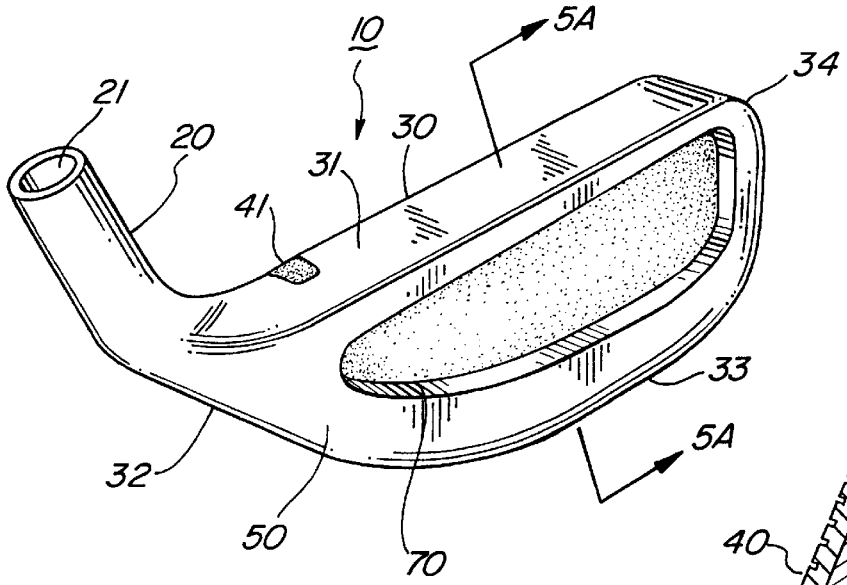
FIG. 5 is similar to FIG. 4 except that the heel-side face slot, the central cavity, and the toe slot have been filled with the vibration-dampening material.

As was the case with the first embodiment involving only a heel-side face aperture 41, the heel-side face slot and central cavity 70 are preferably filled with a vibration dampening material 60 as shown, for example, in FIG. 5. It is believed that providing the vibration-dampening material 60 in the central cavity 70 as well as in the heel-side face slot 41 will result in reduced shock transmission.

Figures 1, 1A, 2, 2A:
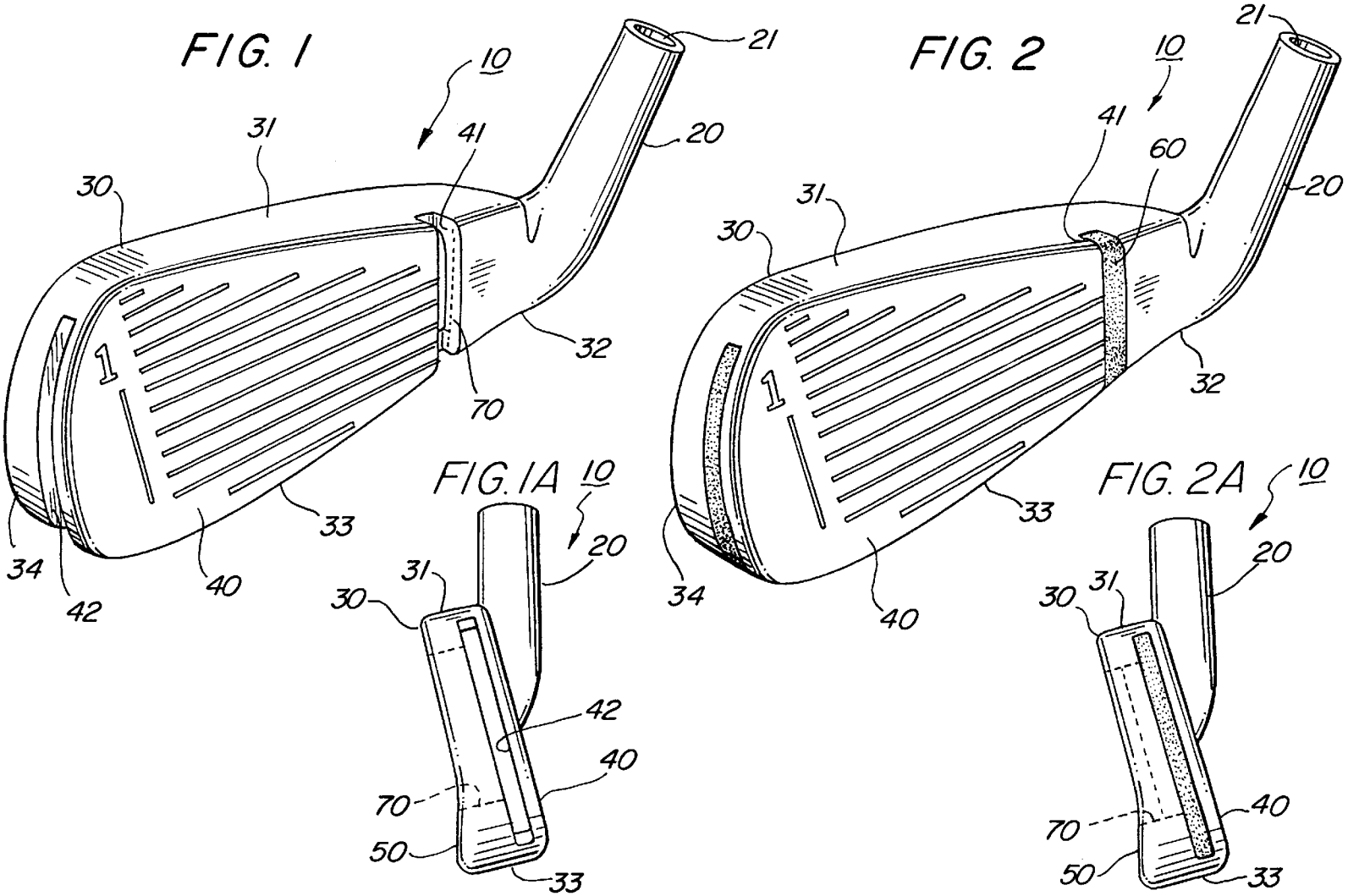
FIG. 1 is a perspective view of a cavity-back golf club head incorporating the present invention wherein the heel-side face slot and the toe slot are visible but do not yet contain a vibration-dampening material.
FIG. 1A is a toe-side end view of the golf club head of FIG. 1.
FIG. 2 is a perspective view of the preferred golf club head of the present invention wherein the heel-side face slot and toe slot contain a vibration-dampening material.
FIG. 2A is a toe-side end view of the golf club head of FIG. 2.
Figures 1, 3B:
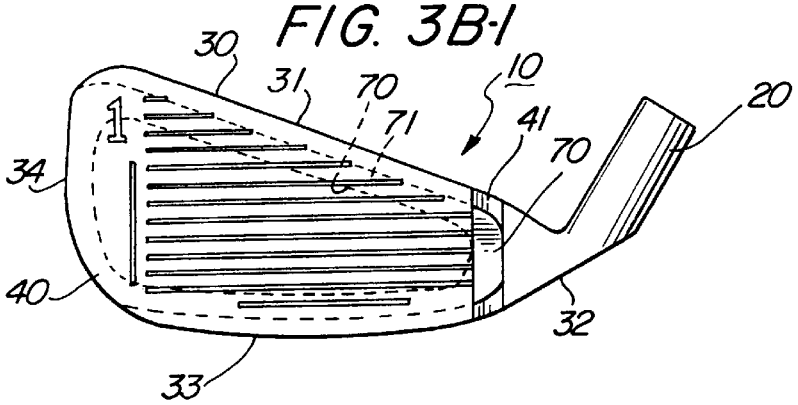
Figures 2, 3B:
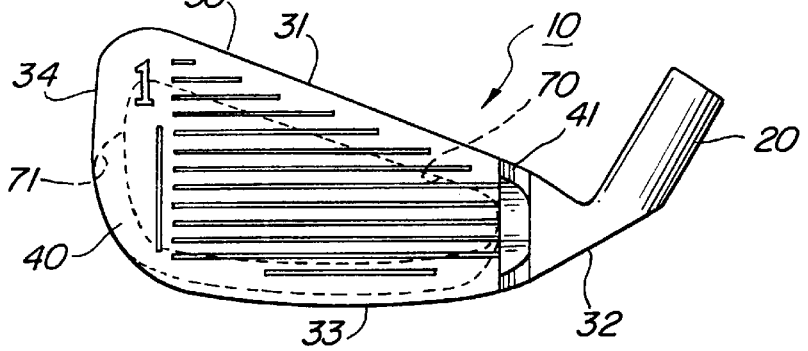
Figure 3C:
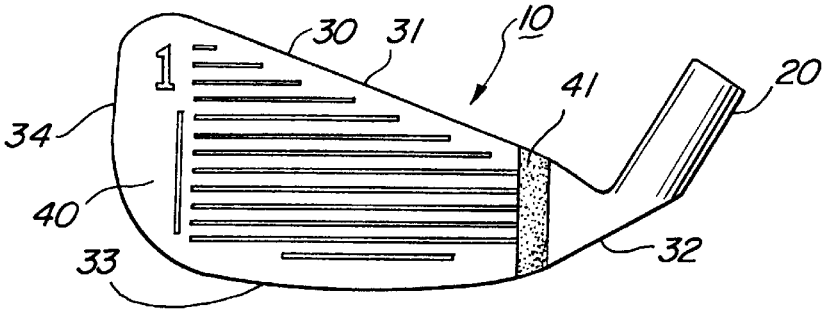
FIG. 3C is similar to FIG. 3A except that it shows the heel-side face slot filled with the vibration-dampening material.
Figure 4:
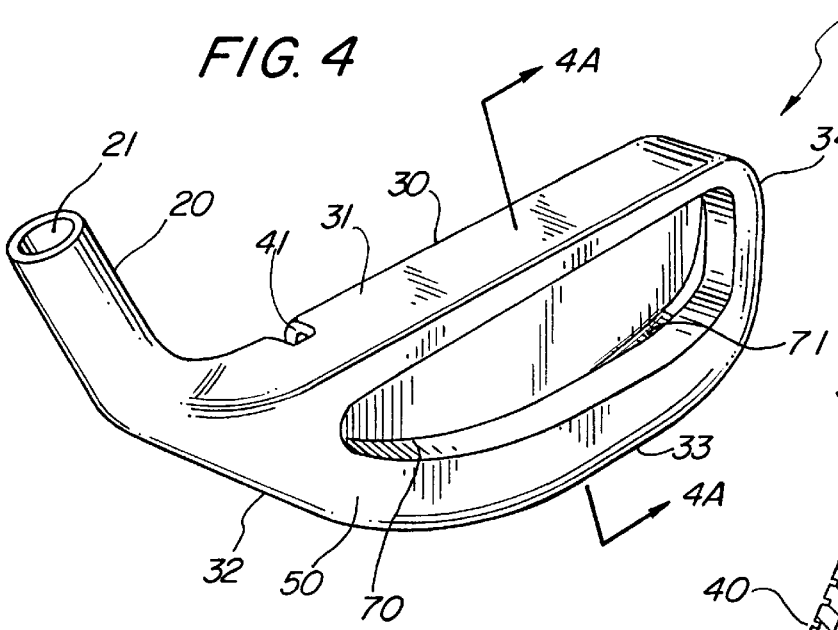
FIG. 4 is a perspective view of a back face of the preferred golf club head of the present invention.
Figure 4A:
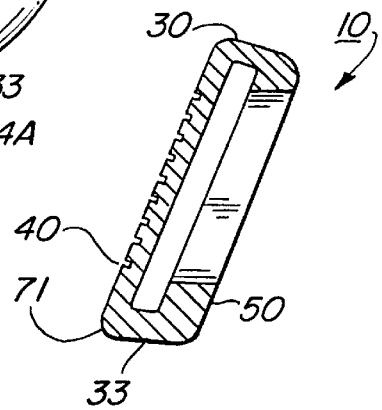
FIG. 4A is a sectional view of FIG. 4 taken along section lines 4A—4A.

In a third embodiment of the golf club head 10 according to the present invention, the central cavity 70 includes a perimeter undercut 71 that is located behind all of the front hitting face 40 or behind only a portion of the front hitting face 40. The perimeter undercut may be a full "360 degree"

undercut 71 as shown in FIG. 3B-1 or may be a partial undercut that extends only toward the heel 32, sole 33 and toe 34 and shown in FIG. 3B-2.

In a fourth embodiment, a golf club head 10 according to the present invention further comprises a toe slot 42 that extends from the toe 34 through the head body 30 to the central cavity 70. The toe slot 42 taken in combination with the heel-side face slot 41 uniquely results in the front hitting face 40 being supported by only the top rail 31 and the sole 33. The front hitting face 40, in other words, is isolated from or "floating" relative to the heel 32 and the toe 34. This is perhaps, best shown in FIG. 6C which is a partial cut-away of a finished golf club head 10 incorporating the aspects of the present invention described to this point. As shown in FIG. 6C, the central cavity 70 is filled with a vibration-dampening material 60 that covers much of the central cavity 70 and flows into the heel-side face slot 41 and the toe slot 42. The front hitting face 40, however, essentially has no direct metal to metal connection in the horizontal plane of the head body 30. As can be appreciated from FIG. 6C, the vibration-dampening material 60 will do a great deal to dampen the transmission of shock from the front hitting face 40 to the hosel 20 upon impact with the golf ball because of (1) the presence of the heel-side face slot 41 which isolates the front hitting face 40 from the hosel 20, (2) the fact that the front hitting face 40 is "floating" relative to the heel 32 and the toe 34 and (3) the presence of the vibration-dampening material 60.

Figure 5A:
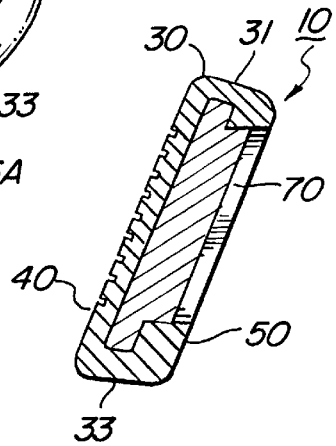
FIG. 5A is a cross-sectional view of FIG. 5 taken along section lines 5A—5A.

FIGS. 7–10 shows a fifth alternative golf club head 10' wherein the front hitting face 40 is completely floating as an "island" 40' within a "sea" 60' of dampening material. In this case, the separate face 40' is adhered to a front cavity (not separately numbered) within the head body 30' by way of an insert 60' formed of an appropriate dampening material. This embodiment differs from the others in that the front hitting face 40' is not supported from above and below by the top rail 31 and sole 33 (see e.g. FIG. 5A). In the preferred embodiment, the golf club head 10' is formed of steel and the separate front hitting face 40' is formed of a harder material such as titanium. It is presently contemplated that the front hitting face 40' is adhered to the head 10' by placing it in urethane that is still in a liquid state. It would be possible, however, to use a dampening material 60' that was pre-formed and assemble the components by some other means such as an adhesive.

In all of the above embodiments, the vibration-dampening material 60, 60' acts in some regard as a rubber die spring that adds to the recoil or rebound that helps the front hitting face 40, 40' return from its maximum deflection before the ball leaves the front hitting face 40, 40'. It is possible, therefore, that the present invention may result in greater distances.

Independent testing has shown that relieving the direct metal to metal support between the heel 32 and toe 34 relative to the front hitting face 40 results in better accuracy given an off-center heel or toe hit. The greater accuracy is the apparent result of the fact that the effective density increases in a conventional club as you move from the center or sweet spot of the front hitting face towards the perimeter of the club head. In other words, there is more metal behind the front hitting face as you near the perimeter weighted edges of the club. The result with a conventional head, therefore, is that there is a physical bias which sprays the ball one way or another if the club face is either opened or closed. In a golf club head 10 according to the present invention, however, there is little if any effective increase in the density behind the front hitting face 40 as you move horizontally away in either direction from the center or sweet spot of the front hitting face 40. As an apparent result of this construction, therefore, the golf club head 10 is more tolerant of off-center shots and of shots wherein the golfer has inadvertently opened or closed the face relative to the ideal.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. A golf club head having a hosel adapted for connection to a shaft and a head body connected to the hosel, the head body and the hosel being made from a metallic material, wherein the head body has a front hitting face having a perimeter and a back face, a top rail, a heel located near the hosel, a sole, and a toe located away from the hosel, the golf club head comprising:

the front hitting face being integral with substantially all of the top rail and the sole, wherein the top rail and the sole comprise of the same metallic material as the head body;

a central cavity behind a back side of the front hitting face; and a heel-side aperture located in the front hitting face near the heel to isolate a heel-side portion of the front hitting face from the hosel, the heel-side aperture extending through the front hitting face to the central cavity.

2. The golf club head of claim 1 wherein the heel-side aperture and the central cavity define a fill void, the golf club head further comprising a dampening material softer than the metallic material of the head body and the hosel, the dampening material being located within the fill void and continuously filling the central cavity and the heel-side aperture.

3. The golf club head of claim 3 wherein the dampening material is a polymer.

4. The golf club head of claim 1 wherein the central cavity is open to the back face, the central cavity thinning a central portion of the golf club head behind the front hitting face and defining a relatively massive perimeter portion.

5. The golf club head of claim 4 wherein the central cavity further comprises a perimeter undercut extending beneath at least a portion of the relatively massive perimeter portion.

6. The golf club head of claim 5 wherein the perimeter undercut is a 360 degree undercut that extends beneath all of the perimeter portion.

7. The golf club head of claim 5 wherein the perimeter undercut extends beneath only a heel, sole, and toe region of the perimeter portion.

8. The golf club head of claim 1 further comprising a toe slot extending from the toe to the central cavity, the front hitting face being isolated from the heel and the toe and integrally supported only from the top rail and the sole, wherein the central cavity is open to the heel-side aperture and the toe slot.

9. The golf club head of claim 8 further comprising a dampening material softer than the metallic material of the head body and the shaft, the dampening material being located continuously within the central cavity, the heel-side aperture, and the toe slot.

10. The golf club head of claim 9 wherein the dampening material is a polymer.

11. The golf club head of claim 4 further comprising a dampening material softer than the metallic material of the head body and the shaft, the dampening material being located continuously within the fill void and the heel-side aperture.

12. The golf club head of claim 4 wherein the central cavity further comprises a perimeter undercut extending beneath at least a portion of the relatively massive perimeter portion.

13. The golf club head of claim 12 wherein the perimeter undercut is a 360 degree undercut that extends beneath all of the perimeter portion.

14. The golf club head of claim 12 wherein the perimeter undercut extends beneath only a heel, sole, and toe region of the perimeter portion.

15. The golf club head of claim 11 wherein the dampening material is a polymer.

16. The golf club head of claim 4 further comprising a toe slot extending from the toe to the central cavity, the front hitting face being isolated from the heel and the toe and integrally supported only from the top rail and the sole, wherein the central cavity is open to the heel-side aperture and the toe slot.

17. The golf club head of claim 16 further comprising a dampening material softer than the metallic material of the head body and the shaft, the dampening material being located continuously within the central cavity, the heel-side aperture, and the toe slot.

18. The golf club head of claim 17 wherein the dampening material is a polymer.

19. The golf club head of claim 1 wherein the central cavity is enclosed by the back face.

20. The golf club head of claim 19 further comprising a toe slot extending from the toe to the central cavity, the front hitting face being isolated from the heel and the toe and integrally supported only from the top rail and the sole, wherein the central cavity is open to the heel-side aperture and the toe slot.

21. The golf club head of claim 20 further comprising a dampening material softer than the metallic material of the head body and the shaft, the dampening material being located continuously within the central cavity, the heel-side aperture, and the toe slot.

22. The golf club head of claim 21 wherein the dampening material is a polymer.

23. The golf club head of claim 19 further comprising a dampening material softer than the metallic material of the head body and the shaft, the dampening material being located continuously within the central cavity and the heel-side aperture.

24. The golf club head of claim 23 wherein the dampening material is a polymer.

25. A golf club head having a hosel adapted for connection to a shaft and a head body connected to the hosel, the hosel and head body being made from a metallic material, wherein the head body has a metallic front hitting face and a back face collectively encompassed by a metallic top rail, a heel located near the hosel, a metallic sole, and a toe located away from the hosel, the golf club head comprising:

a central cavity in the back face which thins a central portion of the golf club head behind the front hitting face and defines a relatively massive perimeter portion;

a heel-side face slot that extends continuously from the top rail to the sole and is open to a heel end of the central cavity in the back face, wherein the front hitting face is integral with the top rail and the sole, whereby a heel-side portion of the front hitting face is isolated from the hosel; and a fill void being defined by the heel-side face slot and the central cavity.

26. The golf club head of claim 25 further comprising a dampening material softer than the metallic material of the hosel and the head body, the dampening material being located within the fill void, the dampening material covering at least a portion of the central cavity and filling the heel-side face slot.

27. The golf club head of claim 26 wherein the dampening material is a polymer.

28. The golf club head of claim 26 wherein the central cavity further comprises a perimeter undercut extending beneath at least a portion of the relatively massive perimeter portion.

29. The golf club head of claim 28 wherein the perimeter undercut is a 360 degree undercut that extends beneath all of the perimeter portion.

30. The golf club head of claim 28 wherein the perimeter undercut extends beneath only a heel, sole, and toe region of the perimeter portion.

31. A golf club head having a hosel adapted for connection to a shaft and a head body connected to the hosel, the head body and hosel being made from a metallic material, wherein the head body has a metallic front hitting face and a back face collectively encompassed by a metallic top rail, a heel located near the hosel, a metallic sole, and a toe located away from the hosel, the golf club head comprising:

a central cavity in the back face extending into the head body to thin a central portion of the golf club head behind a back side of the front hitting face and defining a relatively massive perimeter portion;

a heel-side face slot that extends continuously from the top rail to the sole and is open to a heel end of the central cavity in the back face, a substantial portion of the front hitting face being isolated from the hosel;

a toe slot extending from the toe to the central cavity, the front hitting face being isolated from the heel and the toe, the front hitting face being integral only with the top rail and the sole; and a fill void being defined collectively by the heel-side face slot, the central cavity, and the toe slot.

32. The golf club head of claim 31 further comprising a dampening material softer than the metallic material of the head body and the shaft, the dampening material being located within the fill void.

33. The golf club head of claim 32 wherein the central cavity further comprises a perimeter undercut extending beneath at least a portion of the relatively massive perimeter portion.

34. The golf club head of claim 33 wherein the perimeter undercut is a 360 degree undercut that extends beneath all of the perimeter portion.

35. The golf club head of claim 33 wherein the perimeter undercut extends beneath only a heel, sole, and toe region of the perimeter portion.

* * * * *